US009359873B2

(12) United States Patent
Vestavik

(10) Patent No.: US 9,359,873 B2
(45) Date of Patent: Jun. 7, 2016

(54) METHOD FOR RUNNING CONDUIT IN EXTENDED REACH WELLBORES

(71) Applicant: Reelwell, A.S., Royneberg (NO)

(72) Inventor: Ola Vestavik, Fosnavag (NO)

(73) Assignee: Reelwell, A.S., Royneberg (NO)

( * ) Notice: Subject to any disclaimer, the term of this patent is extended or adjusted under 35 U.S.C. 154(b) by 235 days.

(21) Appl. No.: 14/141,170

(22) Filed: Dec. 26, 2013

(65) Prior Publication Data

US 2015/0184494 A1 Jul. 2, 2015

(51) Int. Cl.

| | |
|---|---|
| ***E21B 43/10*** | (2006.01) |
| ***E21B 17/042*** | (2006.01) |
| ***E21B 19/16*** | (2006.01) |
| ***E21B 33/04*** | (2006.01) |
| ***E21B 19/24*** | (2006.01) |

(52) U.S. Cl.

CPC ..... *E21B 43/10* (2013.01); *E21B 17/042* (2013.01); *E21B 19/16* (2013.01); *E21B 19/24* (2013.01); *E21B 33/04* (2013.01)

(58) Field of Classification Search

CPC ..... E21B 43/305; E21B 43/10; E21B 43/02; E21B 41/00; E21B 17/10; E21B 33/04; E21B 19/16; E21B 34/06; E21B 19/24; E21B 17/042; E21B 21/00; E21B 33/02; E21B 33/08; E21B 21/01

See application file for complete search history.

(56) References Cited

U.S. PATENT DOCUMENTS

| | | | | |
|---|---|---|---|---|
| 3,572,432 | A * | 3/1971 | Aulick | E21B 33/14 166/114 |
| 5,295,536 | A | 3/1994 | Bode | |
| 2003/0116324 | A1 * | 6/2003 | Dawson | E21B 43/305 166/380 |
| 2008/0115942 | A1 * | 5/2008 | Keller | E21B 43/10 166/380 |

FOREIGN PATENT DOCUMENTS

| | | | |
|---|---|---|---|
| WO | 0246571 | A1 | 6/2002 |
| WO | 03054340 | A2 | 7/2003 |
| WO | 2006101606 | A2 | 9/2006 |

OTHER PUBLICATIONS

Notification of Transmittal of the International Search Report and the Written Opinion of the International Searching Authority from PCT/IB2014/066326 of Aug. 18, 2015.

* cited by examiner

*Primary Examiner* — Yong-Suk (Philip) Ro
(74) *Attorney, Agent, or Firm* — Richard A. Fagin

(57) ABSTRACT

A method for inserting a conduit into a wellbore includes inserting the conduit into the wellbore until an upper end of a predetermined section thereof is disposed proximate a selected position in the wellbore and reducing pressure in the conduit to a predetermined pressure.

13 Claims, 4 Drawing Sheets

Pick up Casing Vacuum Tool

Install Casing Vacuum Tool on casing collar

Vacuum the casing volume

Make-up casing joints

Pull off the Vacuum Tool

METHOD FOR RUNNING CONDUIT IN EXTENDED REACH WELLBORES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure relates generally to the field of inserting conduit such as casing or liners in wellbores having extended lateral displacement from the wellbore surface location, e.g., highly inclined or horizontal wellbores.

"Extended reach" wellbore drilling enables drilling a wellbore and extended lateral (horizontal) displacement from a wellbore's surface location. Extended reach wellbores may be used, for example, to gain access to subsurface reservoirs where it is necessary for regulatory and/or environmental reasons that the wellbore's surface location cannot be proximate the subsurface reservoir. Other uses for extended reach wellbores may be to expose a long section of fractured or other hydrocarbon productive formation having relatively horizontal geologic structure.

It is known in the art to insert a casing or liner in such extended reach wellbores.

Inserting a casing or liner may be facilitated by using casing centralizers at spaced apart locations along the casing or liner to limit frictional contact between the casing or liner and the wall of the wellbore. In some cases, using centralizers is inadequate because of the length of the casing or liner to be inserted into the wellbore. In such cases, even with centralizers, there may be sufficient friction between the centralizers or the conduit and the wellbore wall as to make insertion of the conduit (casing or liner) impracticable.

It is also known in the art to insert the casing or liner in the wellbore while it is air filled. Air filling causes the casing or liner to be buoyant in the fluid filling the wellbore. After the casing or liner is inserted to the longitudinal end of the wellbore, various fluids may be pumped into the casing or liner as part of the process of cementing the casing or liner within the wellbore. Cement is eventually pumped as a slurry through the casing or liner and exits through appropriate valves and other equipment at the longitudinal distal end, eventually being displaced into the annular space ("annulus") between the casing or liner and the wellbore wall. When the cement sets, it may form an impermeable barrier to hydraulically isolate formations from each other and help maintain the mechanical integrity of the wellbore.

Using air to provide buoyancy to run a casing or liner in an extended reach wellbore may have some risk, depending on the trajectory of the wellbore. It is possible under some conditions for air to become trapped in the casing or liner. As fluid is pumped into the casing or liner to begin the cementing process, trapped air can become compressed. When the compressed air is released by opening of the equipment at the bottom of the casing or liner, the pressure may result in dangerous well pressure control conditions.

SUMMARY

A method according to one aspect for inserting a conduit into a wellbore includes inserting the conduit into the wellbore until an upper end of a predetermined section thereof is disposed proximate a selected position in the wellbore and reducing pressure in the conduit to a predetermined pressure.

Other aspects and advantages will be apparent from the description and claims that follow.

DETAILED DESCRIPTION

Figure 1:
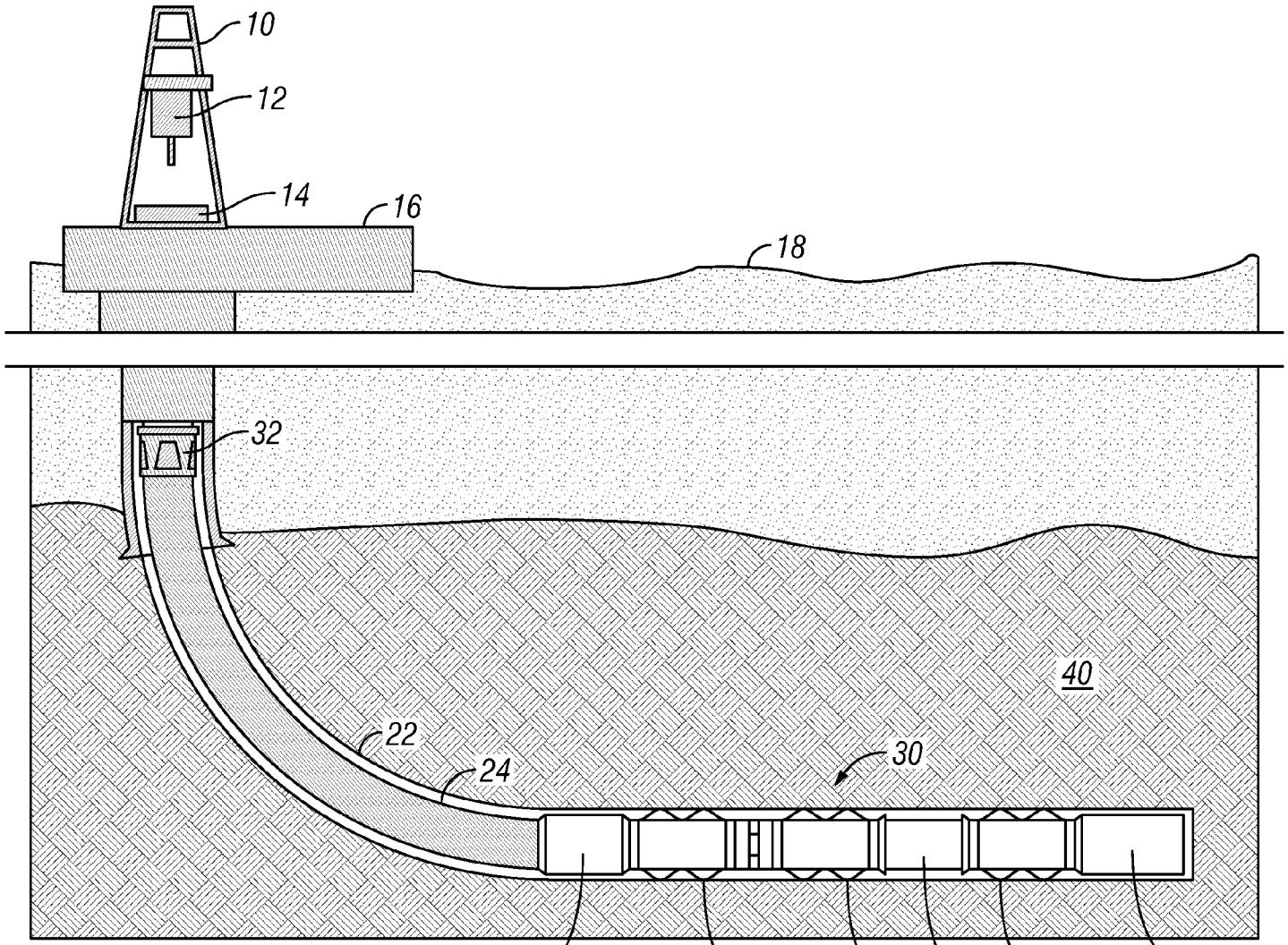
FIG. 1 shows an example casing inserted into a wellbore having a highly inclined section.

FIG. 1 shows an example of a casing 24 inserted into a wellbore 22 drilled through subsurface formations 40. The casing 24 may be assembled by threadedly coupling casing segments or "joints" end to end on a drilling unit 10 or similar lifting device on the land surface 18 (or water surface for marine operations) and as the joints are assembled, the casing 24 is moved axially into the wellbore 22. A section of the wellbore shown at 30 in FIG. 1 may be highly inclined or horizontal, and as explained in the Background section herein, a portion of the casing 24 to be inserted into the section 30 may be kept empty of any liquid so that the casing 24 is substantially buoyant in the section 30 of the wellbore 22. The buoyancy substantially reduces friction between the casing 24 and the wellbore 22 in the highly inclined section 30 of the wellbore. Liquid may be excluded from the casing portion by having a float collar 21 or plug of types well known in the art at an upper (nearer the surface end of the casing) end of the portion and a float valve 28, also of any type known in the art at a lower end of the casing portion. The casing 24 may be supported, in particular but not necessarily exclusively in the section 30 by centralizers 26 of types well known in the art. An upper end 14 of the casing 24 is shown protruding through a drilling deck 16 of the drilling unit 10 for further assembly or other operations. A top drive 12 or other hoisting unit may move segments of the casing 24 for assembly to the casing 24. When the casing 24 is completed, it may be suspended in a surface pipe or wellhead by a casing hanger 32 of types well known in the art.

As explained in the Background section herein, if there is air trapped in the portion of the casing 24, it is possible to cause a well pressure control emergency when the air is released under pressure upon opening of the float valve 21.

Figure 2:
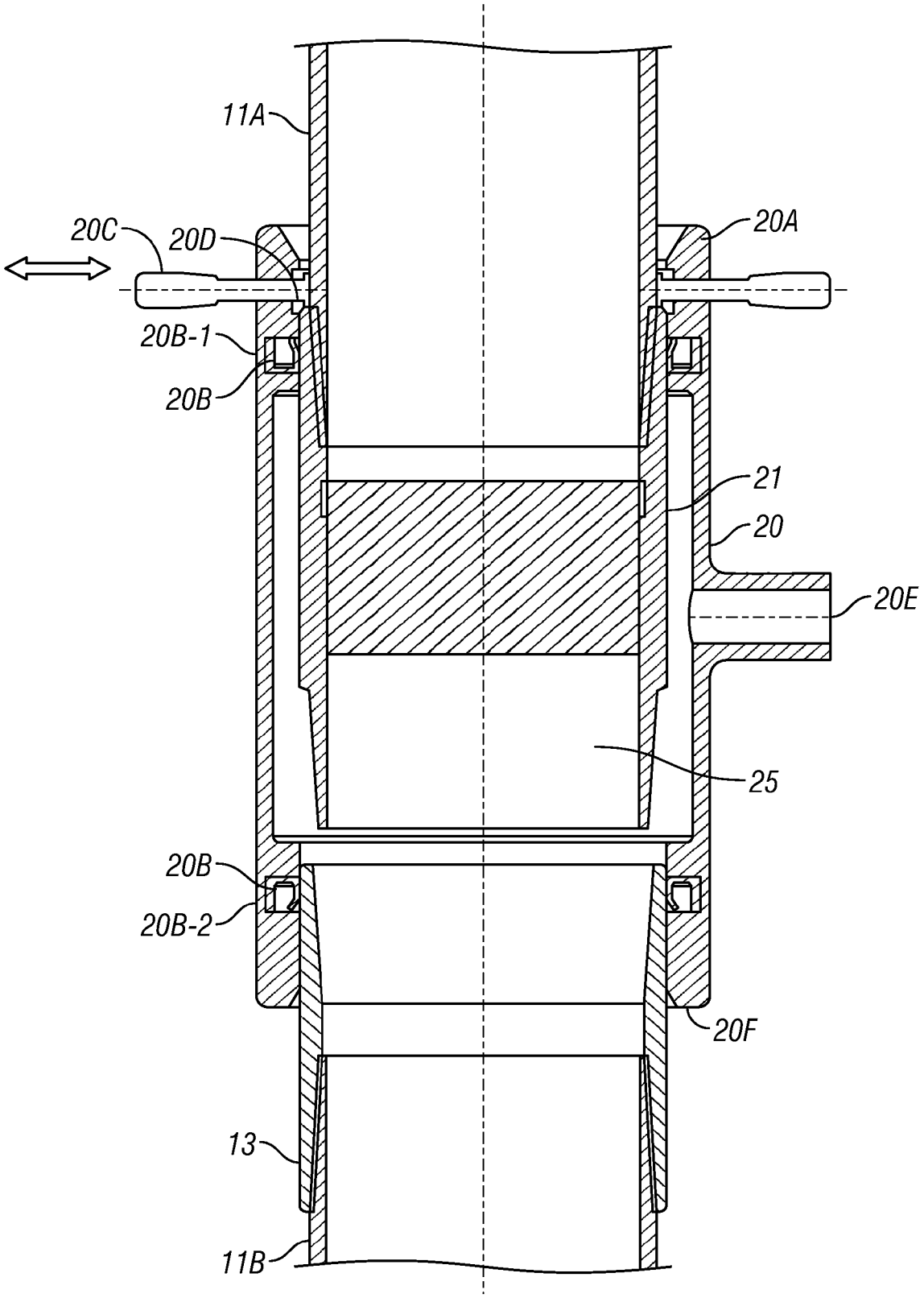
FIG. 2 shows an example casing vacuum fitting that may be used in accordance with the present disclosure.

Referring to FIG. 2, an example casing vacuum fitting 20 that may be used in accordance with the present disclosure will be explained. The casing vacuum fitting 20 may be a closed, substantially cylindrical conduit, or may be a conduit section cut in half, hinged on one side and having a lock (e.g., as shown at 20C) on the other side to enclose the casing vacuum fitting around a longitudinal end of an upper casing joint 11A (suspended by the drilling unit in FIG. 1). The casing vacuum fitting 20 may include an upper guiding tapered interior surface or "funnel" 20A to assist in guiding the casing vacuum fitting 20 onto the upper casing joint 11. The lock 20C if used, or a handle 20D may provide a feature to assist in lifting the casing vacuum fitting 20 onto the upper casing joint 11A. An interior surface of the casing vacuum fitting 20 may have a seal 20B, such as an elastomer ring (or two half-rings for the example hinged casing vacuum fitting) inserted in an upper corresponding groove 20B-1 in an upper part of the casing vacuum fitting 20 to form an air-tight seal against an exterior of the upper casing joint 11A. A diameter of the upper corresponding groove 20B-1 and the seal 20B therein may be selected to seal against a corresponding external diameter casing. A lower corresponding groove 20B-2 and seal 20B therein may have a diameter selected to seal against an exterior of a casing collar 13, if casing collars are used to threadedly connect the casing joints, or may have a diameter selected to seal against an external upset (not shown) where such type of female thread casing joints are used for threadedly coupling casing joints together. The casing vacuum fitting 20 may include a lower interior tapered surface or "funnel" 20F to assist guiding the casing vacuum fitting onto a lower casing joint 11A. The casing vacuum fitting 20 may include a port 20E that may be pneumatically connected to a vacuum pump (FIG. 3) to evacuate the casing section assembled below the casing vacuum fitting 20.

As shown in FIG. 2, the upper casing joint 11A may include a casing flotation collar 21 of any type known in the art. The casing flotation collar 21 may seal an interior of the upper casing joint 11A. FIG. 2 shows the casing vacuum fitting 20 assembled to the upper casing joint 11A and the lower casing joint 11B prior to their threaded coupling to each other, wherein a space 25 in pneumatic communication with the port 20E exists between the casing joints 11A, 11B. It will be appreciated by those skilled in the art that the lower casing joint 11B and the previously assembled portion of the casing may be supported in slips on the drill floor (FIG. 3), while the upper casing joint 11A may be supported by a top drive or similar hoisting device forming part of the drilling unit (FIG. 1).

Figure 3:
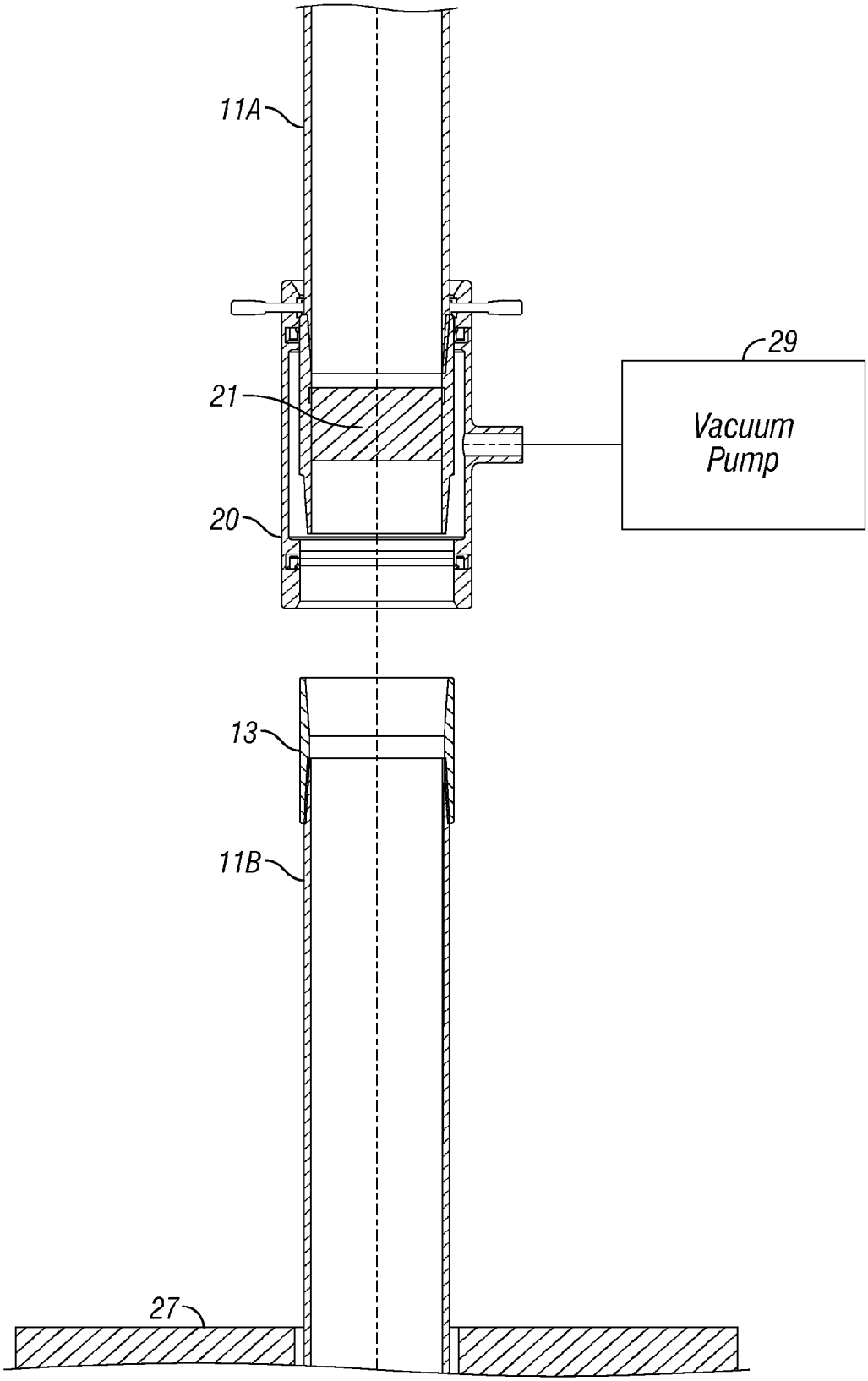
FIG. 3 shows the casing vacuum fitting of FIG. 2 coupled to a casing joint prior to affixing the fitting to an adjacent casing joint.

FIG. 3 shows the casing vacuum fitting 20 assembled to the upper casing joint 11A suspended over the lower casing joint 11B, and with a vacuum pump 29 connected to the port (20E in FIG. 2). As explained above, the lower casing joint 11B and all assembled casing below are suspended in slips (not shown) in the drill floor 27. During operation, the upper casing joint 11A will be lowered so that the casing vacuum fitting 20 engages and seals against the lower casing joint 11B, while leaving the space (25 in FIG. 2). When the lowering is completed, the casing joints 11A, 11B and casing vacuum fitting 20 will be configured as shown in FIG. 2. The vacuum pump 29 is then operated to reduce the air pressure inside the assembled casing (from joint 11B to the bottom of the assembled casing below), the space (25 in FIG. 2) and the upper casing joint 11A. The amount of pressure reduction may depend on, among other factors, the length of the buoyant section of casing, the vertical depth of the buoyant section of casing, the hydrostatic pressure and pumping pressure of fluid used to displace the float collar, and the fracture gradient of the formations adjacent the buoyant section of casing. In some cases only a small pressure reduction will be needed to avoid displacement of air from the buoyant section causing a well pressure control emergency. In other cases it may be necessary to reduce the air pressure to nearly complete vacuum, i.e., an absolute pressure proximate zero. Those skilled in the art will readily be able to make the calculations necessary to determine a required amount of pressure reduction.

After the pressure is reduced, the upper casing joint 11A may be threadedly coupled to the lower casing joint 11B. The casing vacuum fitting 20 may then be removed. After removal of the casing vacuum fitting 20, casing assembly and running to the bottom of the wellbore may proceed in the ordinary manner. After running the casing, a spacer fluid and cement may be pumped therein to enable cement to fill an annular space between the casing and the wellbore as in the ordinary manner.

Figure 4:
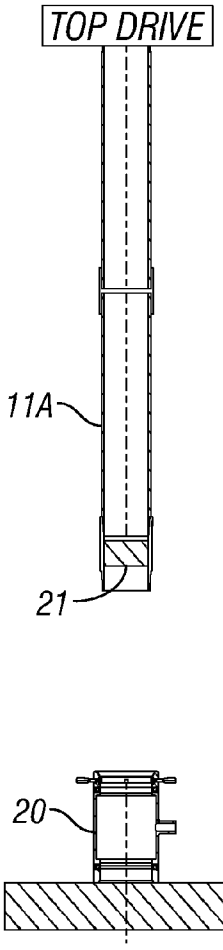
FIGS. 4 through 8 show a sequence of events in an example vacuuming and casing running method according to the present disclosure.

Events as described above for reducing pressure in a section of a casing as explained above are illustrated sequentially in FIGS. 4 through 8. Referring to FIG. 4, casing is assembled in the ordinary manner, e.g., having a float shoe at a bottom end of the casing and threadedly connecting successive joints of casing to the existing assembled casing. The existing assembled casing is lowered into the wellbore as each successive joint is assembled thereto. In the present example, the buoyant section of the casing may extend from the bottom (distal) end to a selected axial distance from the bottom end. When an uppermost end of the buoyant section is assembled to the casing, the assembled casing may then be suspended ("hung off") in the slips in the drill floor (27 in FIG. 3). The suspended joint of casing at the upper end of the assembled casing becomes the lower casing joint 11B for purposes of the remainder of a procedure according to the present disclosure. The upper joint of casing 11A is lifted into the top drive or other hoisting device and may be suspended over the hung off casing (i.e., lower casing joint 11B). The upper casing joint 11A may include a float collar (21 in FIG. 2) as explained above. The casing vacuum fitting 20 may then be lifted onto and clamped to the upper casing joint 11A.

Figure 5:
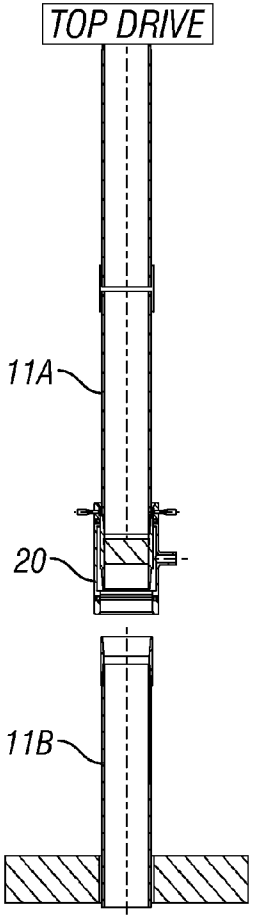

FIG. 5 shows the assembled upper casing joint 11A and casing vacuum fitting 20 being lowered onto the hung off lower casing joint 11B. The lowering proceeds until the casing vacuum fitting sealingly engages the lower casing joint 11B (or the casing collar 13 in FIG. 2 when collars are used). The lowering is stopped so that the space (25 in FIG. 2) in pneumatic communication with the port (25 in FIG. 2) is maintained.

Figure 6:
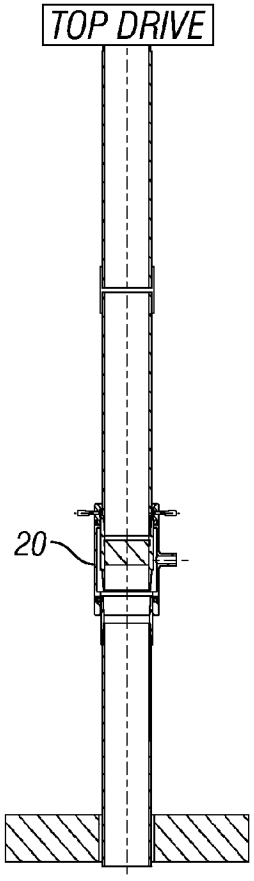
Figure 7:
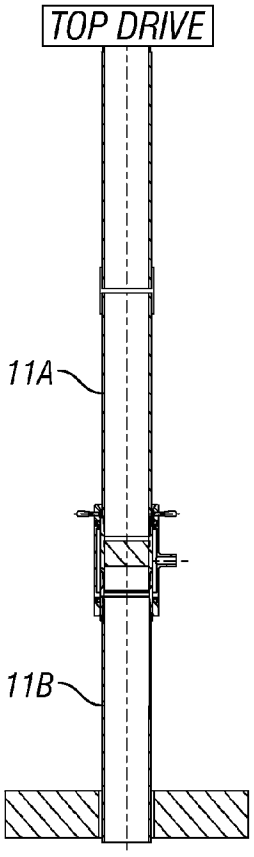

In FIG. 6, the upper casing joint 11A sealingly coupled to the lower casing joint 11B by the casing vacuum fitting 20 are then connected to the vacuum pump as shown in FIG. 3 and the pressure inside the casing is lowered a selected amount. After the pressure is reduced by the selected amount, in FIG. 7, the upper casing joint 11A and the lower casing joint 11B are threadedly connected.

Figure 8:
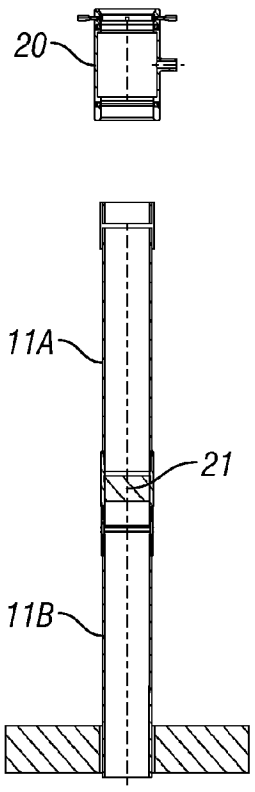

In FIG. 8, the assembled upper 11A and lower 11B casing joints may be disconnected from the top drive or other hoisting device, and the casing vacuum fitting 20 may be removed. The entire casing assembled below the float collar 21 will then have an internal pressure equal to the selected reduced pressure. Casing assembly and running may then proceed in the ordinary manner until the assembled casing is fully inserted into the wellbore.

It is to be clearly understood that the foregoing described procedure is equally applicable to a liner, i.e., a pipe string that only extends from a first selected depth in the wellbore to a second, shallower depth in the wellbore, typically sealingly engaged to an interior surface of a casing already disposed in the wellbore using a liner hanger or similar device. Thus for purposes of defining the scope of the present disclosure, the buoyant section may be described as a wellbore conduit section, rather than just a liner section or a casing section. The present example method is equally applicable to both types or any other type of wellbore conduit requiring buoyancy in liquid and reduced internal pressure, for example, coiled tubing.

It is also to be clearly understood that while the example procedure described above, wherein only a part of the casing or liner has its internal pressure reduced, it is within the scope of the present disclosure to insert the casing, liner or other conduit into the wellbore in its entirety, and then reduce the pressure therein over the entire length of inserted casing. In some examples a conventional cementing valve may be coupled to the vacuum pump to reduce the pressure inside the conduit. The upper end of the conduit may be sealed by a plug as explained with reference to FIGS. 4 through 8. The conduit in such examples may be inserted to its final position in the wellbore prior to reducing pressure. Such position may be, for example to a depth of a casing hanger at the upper end of a casing if the conduit is a casing, or to the depth of a liner hanger at the upper end of a liner when a liner is used.

Reducing pressure in a casing, liner or other conduit according to the present disclosure may improve the efficiency with which such conduits are inserted into wellbores and may reduce the chances of a well pressure control event occurring when the bottom end of the conduit is hydraulically connected to the wellbore annular space during subsequent fluid and cement pumping operations.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for inserting a conduit into a wellbore, comprising:

inserting the conduit into the wellbore until an upper end of a predetermined section of the conduit is disposed proximate a first selected position in the wellbore;

suspending a subsequent segment of the conduit above the upper end of the conduit leaving a space between the upper end of the conduit and a lower end of the subsequent segment, the subsequent segment comprising a seal in an interior thereof;

sealingly engaging the upper end of the conduit and the lower end of the subsequent segment to a vacuum pump while maintaining the space; and operating the vacuum pump to reduce pressure in the conduit and the subsequent segment to a predetermined pressure.

2. The method of claim 1 further comprising coupling the subsequent segment to the conduit and continuing inserting the assembled subsequent segment and the conduit into the wellbore until the conduit is disposed at a second selected position in the wellbore.

3. The method of claim 2 wherein coupling the subsequent segment to the conduit comprises threadedly coupling the upper end of the conduit to the lower end of the subsequent segment to end.

4. The method of claim 3 wherein the threadedly coupling comprises using a collar between the conduit and the subsequent segment.

5. The method of claim 1 wherein the sealingly engaging comprises engaging a vacuum fitting with the subsequent segment and the upper end, the vacuum fitting comprising a conduit having a first internal seal configured to engage the upper end of the conduit and having a second internal seal configured to engage the lower end subsequent segment.

6. The method of claim 5 wherein the vacuum fitting comprises a port in pneumatic communication with the space.

7. The method of claim 1 wherein the conduit comprises a casing.

8. The method of claim 1 wherein the conduit comprises a liner.

9. The method of claim 1 wherein the predetermined pressure is substantially zero absolute pressure.

10. The method of claim 1 wherein the predetermined section comprises a portion of the conduit to be disposed in section of the wellbore wherein the conduit is to be buoyantly supported.

11. The method of claim 1 wherein the first selected position is proximate a bottom of the wellbore.

12. The method of claim 1 wherein the first selected position comprises an upper end of the conduit being disposed proximate at least one of a casing hanger and a liner hanger.

13. The method of claim 1 wherein the second selected position comprises a lower end of the conduit being disposed proximate a bottom of the wellbore.

* * * * *